United States Patent [19]

Odhner

[11] 4,007,509

[45] Feb. 15, 1977

[54] BLACKBOARD ERASER

[76] Inventor: Oliver R. Odhner, R.D. No. 2, Gerloff Road, Schwenksville, Pa. 19473

[22] Filed: Mar. 3, 1975

[21] Appl. No.: 554,503

[52] U.S. Cl. ..... 15/159 A; 15/192; 15/221

[51] Int. Cl.[2] ..... A46B 3/02; A46B 9/02

[58] Field of Search ..... 15/159, 160, 191–193, 15/202, 221, 224, 159 A; 51/400

[56] References Cited

UNITED STATES PATENTS

| | | | |
|---|---|---|---|
| 522,469 | 7/1894 | Kious | 15/221 |
| 957,078 | 5/1910 | Miller | 15/202 |
| 1,020,373 | 3/1912 | Seaboyer | 15/202 X |
| 1,359,104 | 11/1920 | Rheinberger | 15/104 R |
| 1,685,328 | 9/1928 | Kogler et al. | 15/202 |
| 3,072,945 | 1/1963 | Peterson | 15/202 |
| 3,577,839 | 5/1971 | Charvat et al. | 51/400 |

FOREIGN PATENTS OR APPLICATIONS

| | | | |
|---|---|---|---|
| 1,267,575 | 6/1961 | France | 15/192 |
| 700,294 | 11/1953 | United Kingdom | 15/192 |

*Primary Examiner*—Peter Feldman
*Attorney, Agent, or Firm*—Frederick J. Olsson

[57] ABSTRACT

Blackboard eraser having a handle made of foamed plastic. Discreet rows of fiberglass filaments for cleaning off the chalk are secured to the bottom of the handle. Channels between the rows collect dust during the erasing operation so that the fibers don't clog. Preferably, the channels are closed off to prevent dust from falling away during erasing. The channels are self-cleaning in that the dust falls away when the eraser is placed on the sill.

11 Claims, 7 Drawing Figures

BLACKBOARD ERASER

This invention relates to an improved eraser for cleaning blackboards.

The invention contemplates an eraser having a handle fabricated from foamed plastic and carrying on one surface (the bottom) several rows of fiberglass filaments which are used to scrape off the chalk when the device is moved back and forth over the surface of the board.

The major objectives of the invention are enumerated below not necessarily in the order of their importance.

One object of the invention is to provide an eraser wherein the cleaning means comprises fiberglass filaments dimensioned and disposed to scrape off the chalk without becoming clogged with dust.

Another object of the invention is to provide an eraser wherein the cleaning means comprises fiberglass filaments dimensioned and disposed to effectively scrape off the chalk without release of the dust into the air.

Another object of the invention is to provide an eraser of the kind in question wherein the fiberglass filaments are arranged in groups or rows with channels between the rows functioning to collect dust during the erasing operation and thereby avoid clogging of the filaments.

Another object of the invention is to provide an eraser of the kind in question wherein fiberglass filaments are arranged in discreet groups or rows with channels between the rows functioning to collect dust during the erasing operation, the ends of the channels being closed off so that the channels contain the dust and prevent dispersion in the air.

Another object of the invention is to provide a fiberglass eraser of the kind in question wherein the filaments have a diameter between 0.00025 inch and 0.00050 inch and which are of an exposed length, preferably between ⅜ inches and ⅝ inches so that during the erasing operation the filaments remain upright or stiff whereby to avoid a matting or spreading of the filaments.

Another object of the invention is to provide an eraser of the kind in question wherein the fiberglass filaments have a diameter between 0.00025 inches and 0.00050 inches so as to reduce wear, enhance rigidity for scraping and make the device essentially self-cleaning.

Another object of the invention is to provide an eraser wherein rows of fiberglass filaments are used as the scraping medium, each row being generally elongated and having millions of filaments standing side by side in a generally parallel relationship and all locked together along one end by an enlarged, hardened adhesive bead.

Another object of the invention is to provide an eraser wherein rows of fiberglass filaments are used as the scraping medium, each row being generally elongated and having millions of filaments standing side by side in a generally parallel relationship and all locked together by a strand of fiberglass which runs along closely adjacent to or touching the filament ends and by a hardened adhesive bead which encapsulates both the strand and the ends.

Figure 1:
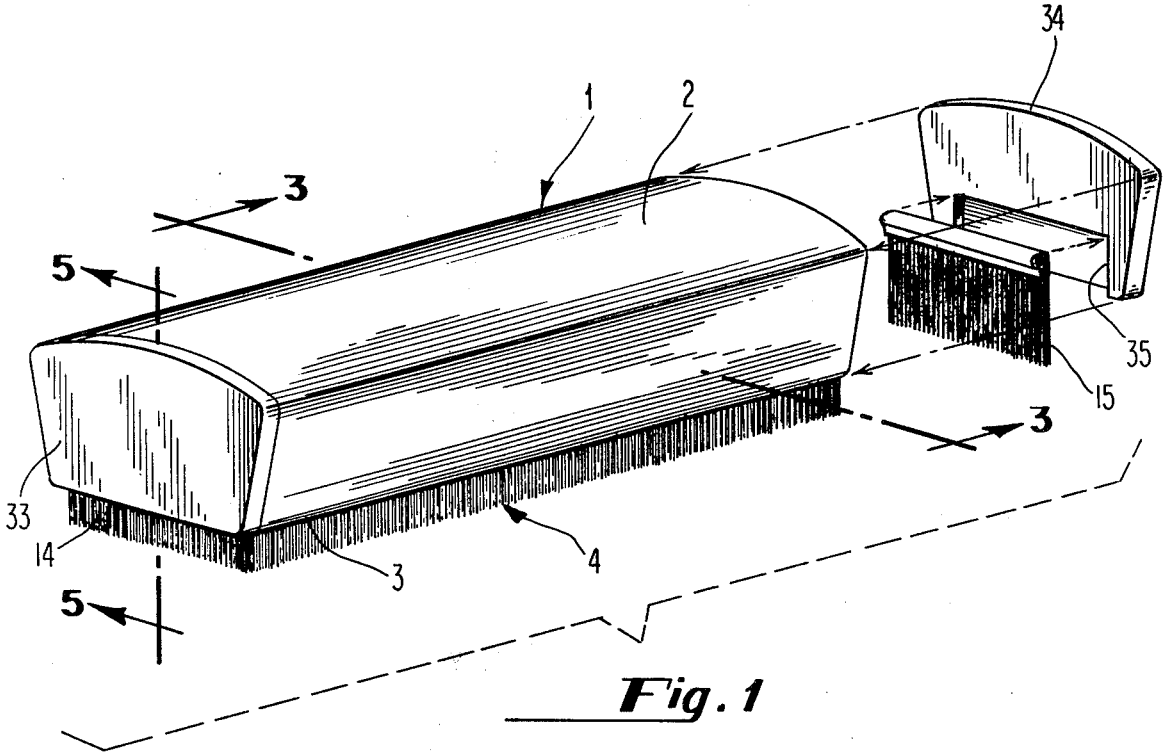
FIG. 1 is a partially exploded perspective view of an eraser constructed in accordance with the invention.

In FIG. 1, the eraser 1 has a handle 2 which is contoured so that it can be conveniently gripped by the fingers and guided back and forth over a blackboard for the erasing operation.

The bottom 3 of the eraser supports the erasing or cleaning means 4 which will scrape off the chalk when the eraser is moved back and forth across the board. This cleaning means comprises millions of closely packed fiberglass filaments which extend down from the bottom of the handle. The bottom 3 of the handle is essentially flat or planar and preferably the filaments are arranged to extend substantially normal to the bottom. Each filament has a diameter between 0.00025 and 0.00050 inches and a length (bottom to end) between ⅜ and ⅝ inches. Filaments of the kind mentioned have several advantages. For example, the filaments have good wear qualities and are less likely to break and also function to enhance the scraping efficiency by remaining stiff or upright while being scraped and thus avoid matting or spreading.

The invention contemplates that the millions of filaments be arranged on the bottom in groups or rows with the groups or rows being separated to provide discreet spaces or channels between adjacent groups. The function of the channels is to collect the dust as it is scraped off the blackboard.

Figure 2:
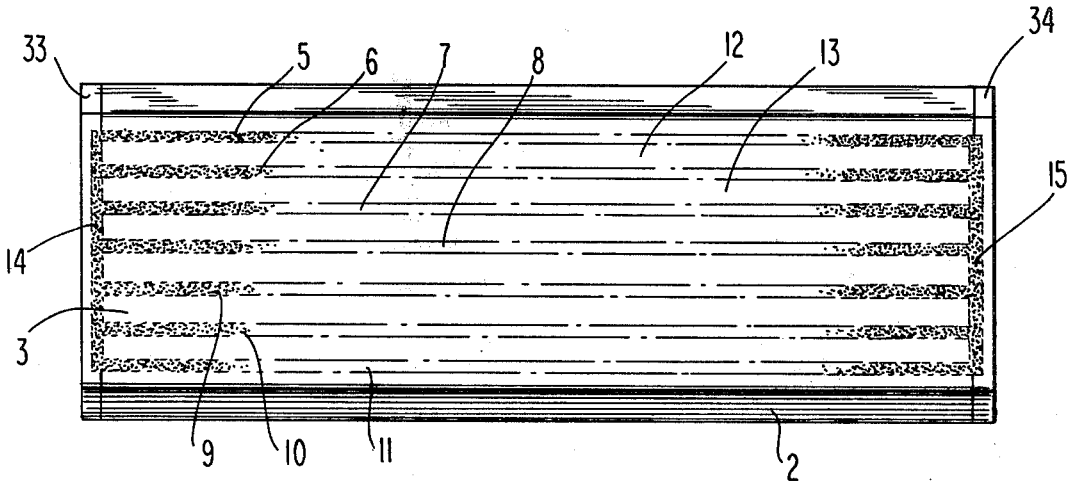
FIG. 2 is a bottom view of the eraser of FIG. 1.

A preferred arrangement of the cleaning groups or rows is illustrated in FIG. 2. As noted, there are seven rows of filaments numbered 5 thru 11. The rows are parallel to one another and adjacent rows are separated so as to form a channel. For example, the rows 5 and 6 are separated to form the channel 12. The rows 6 and 7 are separated to form the channel 13, etc.

Figure 3:
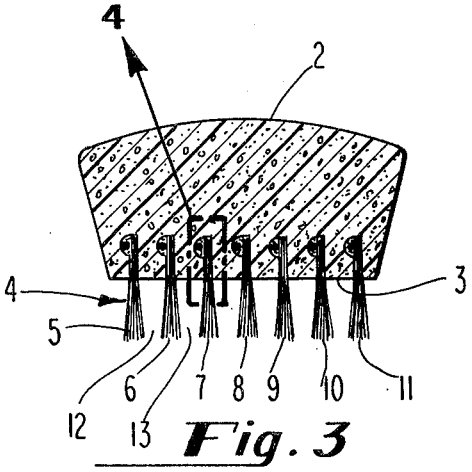
FIG. 3 is a cross-section taken on the lines 3—3 of FIG. 1.

With reference to FIG. 3 it will be noted that the filaments all extend generally normal to the bottom 3 and the length of each filament is such that the locus of the extremeties is a plane. The structure is preferred to enhance the scraping function.

With reference to FIG. 2 it will be observed that the various rows 5 thru 11 are all of the same length and terminate so that their respective ends lie in parallel planes.

In the preferred arrangement, the invention contemplates that the open ends of the channels be blocked or closed off so as to confine or box in the chalk dust as the board is being cleaned. In the arrangement of FIG. 2 this is done by blocking rows of filaments as indicated at 14 and 15. These blocking rows lie in or adjacent to the planes encompassing the terminal ends of the rows 5 to 15. In the preferred arrangement, the rows 14 and 15 are of the same structure as the rows 5 thru 11.

Trapping the chalk dust in the channels has several important advantages. One is that the dust is less likely to be dispersed in the air. Another advantage is in cleaning of the eraser, i.e., the same can be simply put down on the blackboard sill and the chalk dust falls away. A slight tapping will enhance the action.

In the arrangement of FIG. 2, it will be noted that the cleaning rows 5 and 11 together with the blocking rows 14 and 15 extend around the periphery of the handle. Thus, the rows 5 and 11 serve the blocking function as well as the cleaning function.

Preferably, the handle is made from foamed plastic such as ABS, PVC or polystyrene. These foam plastics have light weight and high strength, may be formed of any desired color and are relatively inexpensive.

The structure of the rows or groups of filaments and the manner in which they are connected to the handle will be described in connection with FIGS. 3 thru 6.

Figure 6:
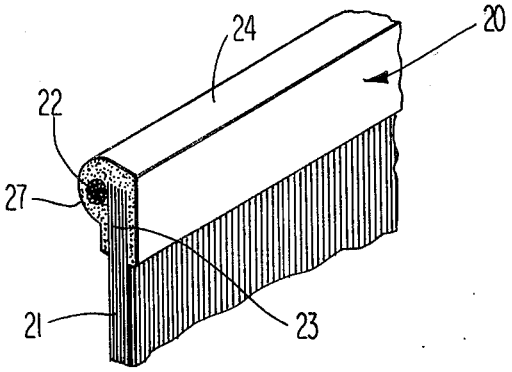
FIG. 6 is a perspective view of a portion of a strip of fiberglass used in the cleaning rows of the eraser of FIG. 1.

In the preferred arrangement, the invention contemplates that each row of fiberglass filaments be set up in an elongated strip-like form 20 as diagramatically illustrated in FIG. 6. The strip 20 includes the downwardly extending fiberglass filaments 21, a reinforcing strand 22 adjacent the edge 23 of the filaments, and a hardened adhesive plastic bead 24 which encapsulates the strand 22 and end 23 and lock the same together.

The strand 22 is shown disposed on the left side of the edge 23. It will be understood that the strand may be located on the right side or on the top. The strand 22 is preferable made of fiberglass, however, other materials such as cotton cord which will serve as a reinforcing member for the strip 20 may be used.

The handle for a classroom type eraser is about six inches in length. A handle for a custodial type eraser is about 18 inches in length. The strips 20 are formed in lengths appropriate for the particular eraser application.

Figure 7:
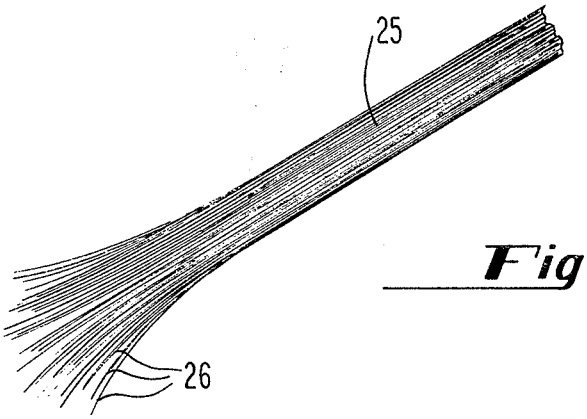
FIG. 7 is an enlarged perspective view of a strand of fiberglass.

The filaments 21 of the strip 20 are fabricated from a strand of fiberglass such as the strand 25 diagramatically illustrated in FIG. 7. A single strand consists of up to sixty ends 26 of fiberglass and each end comprises about 200 filaments. A typical strand may have 30 ends. A strand which I have used and found satisfactory is Owens-Corning Constant Strand Roving 47AA225. In this strand the filaments have a diameter of approximately 0.00035. The strip 20 is preferably manufactured according to the following technique. The strand 25 is payed off its roll and sequentially severed into short sections of the same length, the sections being laid side-by-side in a strip-like array. The reinforcing strip 22 is then positioned along or adjacent to one end of the cut sections. A bead of plastic adhesive such as "Polyite 31-451" polyester resin (catalized with 2% benzoyl peroxide and thickened with permed silica) sold by Reichhold Chemicals, Inc. is laid down along the edge 23 of the filaments and along reinforcing strand 22. The adhesive is troweled or worked in so that it completely covers or encapsulates the end 23 and the reinforcing strand 22. The bead is subsequently cured so that it hardens into a dense hard mass. The adhesive holds or locks the fibers tightly in position. The strips are cut to desired length and then positioned in the handle 2 as will be described below.

The invention contemplates that the adhesive be worked on the edge 23 so that it forms an enlarged bead 27 extending out beyond the width of the fiberglass strands or the row. By placing the strand 22 on the side of edge 23 as shown, the enlarged bead formation is facilitated. One functional purpose of the enlarged bead is to hold the strip 20 in the handle as will be explained below.

It will be understood that the term "adhesive" is used in the descriptive sense, that is to say, it is a material which has the function of holding the fiberglass filaments together. The hardened adhesive also performs the function of a structural member in maintaining the strip in the elongated form illustrated. The strand 22 being impregnated and hardened also performs the function of a structural member. A very high strength structural plastic may be used as the adhesive, for example, nylon (polyamide) resin. In such cases, the invention contemplates elimination of the strand 22.

Figure 4:
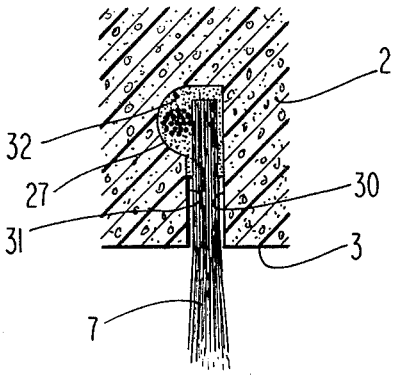
FIG. 4 is an enlarged view of a portion of FIG. 3.

Referring to FIGS. 3 and 4 a plurality of grooves 30 are formed in the handle. The grooves extned along the length of the handle from end to end and are open to the bottom surface 3. Each groove has a lower section 31 and enlarged upper section or cavity 32. The grooves are made after the handle is formed and this is preferably done by a cutting tool. Alternatively, a saw may form the section 31 and an expander type tool expand the inner end into the cavity 32.

The lower section 31 contains a portion of the fiberglass filaments and the enlarged upper section 32 contains the bead 27. The enlarged bead in the cavity acts as a retainer for the strip. The friction between the groove and the strip is sufficient to retain the strip in position but a suitable adhesive may be employed. Each strip is placed in a groove simply by aligning the strip with an open end of the groove and pushing the strip inwardly.

In a custodial type eraser, the blocking rows 14 and 15 may be eliminated as the long length minimizes dust dispersion. In the classroom type eraser, however, the use of the blocking rows is highly desirable.

In the preferred arrangement the blocking rows 14 and 15 are held in position by the end pieces 33 and 34. With reference to end piece 34 in FIG. 1 it will be seen that the end piece includes a socket 35 which is shaped to receive blocking row 15. The end piece is held against the handle by an adhesive such as a suitable hot melt glue.

Figure 5:
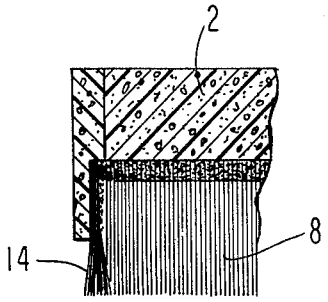
FIG. 5 is a fragmentary cross-section taken on the line 5—5 of FIG. 1.

The blocking row is fitted in the socket so that when the end piece is firm against the handle the blocking piece is in the position shown in FIGS. 2 and 5. Blocking pieces 14 and 15 can be held in by friction. However, it is preferred that an adhesive be employed to hold the blocking piece in the socket. This may be the same adhesive used for the end pieces. The glue also acts to hold the ends of the cleaning rows.

I claim:

1. In a blackboard eraser:

an elongated handle to be gripped by the hand and guided over the surface of the blackboard, the handle having a bottom surface the locus of which is planar and adapted to face the blackboard during the erasing operation;

means on the bottom surface for removing chalk from the blackboard, said means comprising a plurality of parallel cleaning rows, and each row being comprised of a plurality of fiberglass filaments, the rows and the surface forming a plurality of channels; and at the respective opposite ends of the rows, a blocking row of fiberglass filaments closing off the channels between the rows, the closed channels functioning to confine the chalk dust and thereby prevent the dust from falling away during the erasing operation;

a pair of end caps respectively disposed on opposite ends of the handle to maintain said blocking rows in position;

on respectively the same end of each filament, means to lock the filaments together comprising at least one elongated strand extending along and closely adjacent to each said filament end and an enlarged, elongated bead of hardened adhesive encapsulating the strand and each of said ends; and a plurality of grooves formed in said handle and open to said surface, each groove containing a cleaning row including said enlarged bead and a portion of the filaments thereof.

2. The eraser of claim 1 wherein said handle is formed from an extruded, foamed plastic.

3. In a blackboard eraser:

an elongated handle to be gripped by hand and guided over the surface of a blackboard for the erasing operation, the handle having a bottom surface the locus of which is planar and adapted to face the blackboard during the erasing operation;

means on the bottom surface for removing chalk from the blackboard, said means comprising a plurality of cleaning rows each row having a plurality of fiberglass filaments and the rows and surface forming a plurality of channels; and for each row, means to secure the filaments to the handle including a groove in the handle in which the filaments are disposed, and the groove having an enlarged inner section and an elongated bead in said enlarged inner section encapsulating the same end of each filament, the bead holding the filaments and the groove holding the bead.

4. The eraser of claim 3 wherein said fiberglass filaments extend normal to said bottom surface.

5. A construction in accordance with claim 3 wherein the respective ends of the rows terminate in planes and further including at each end a transverse blocking row of fiberglass filaments, the respective rows closing off the ends of the channels and the closed channels functioning to confine the chalk dust and thereby prevent the dust from falling away during the erasing operation.

6. The eraser of claim 3 wherein said handle is formed from an extruded, foamed plastic.

7. In a blackboard eraser:

an elongated handle to be gripped by the hand and guided over the surface of the blackboard, the handle having a bottom surface the locus of which is planar and adapted to face the blackboard when the handle is being guided;

means on the bottom surface for removing chalk from the blackboard, said means comprising a plurality of cleaning rows, the rows and the surface forming a plurality of channels and each row being comprised of a plurality of short fiberglass filaments; and at the respective opposite ends of the rows, a blocking row comprised of a plurality of fiberglass filaments closing off the channels between the rows, the closed channels functioning to confine the chalk dust and thereby prevent the dust from falling away during the erasing operation all of said filaments being of uniform length.

8. The eraser of claim 7 wherein the filaments in said cleaning rows extend normal to said planar surface.

9. The eraser of claim 7 further including a pair of end caps respectively disposed on opposite ends of the handle to maintain said blocking rows in a position.

10. In a blackboard eraser:

an elongated handle to be gripped by the hand and guided over the surface of a blackboard, the handle having a bottom surface the locus of which is planar and adapted to face the blackboard when the handle is guided during the erasing operation;

means on the bottom surface for removing chalk dust from the blackboard comprising a plurality of cleaning groups, the groups being spaced apart to provide spaced channels therebetween for receiving the chalk dust during the cleaning operation and each group being comprised of a plurality of short fiberglass filaments all of said filaments being of uniform length; and means on the handle and extending around the periphery of said bottom surface and also extending from the bottom surface to the ends of the filaments to close off said channels whereby to prevent dust from dropping out of the channels when the device is moved over the board for the cleaning operation.

11. A construction in accordance with claim 10 wherein said means around the periphery comprises a plurality of fiberglass filaments.

* * * * *